US009899777B2

(12) United States Patent
Wendt

(10) Patent No.: US 9,899,777 B2
(45) Date of Patent: Feb. 20, 2018

(54) CONNECTION ARRANGEMENT

(71) Applicant: Phoenix Contact GmbH & Co. KG, Blomberg (DE)

(72) Inventor: Andreas Wendt, Berlin (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/127,419

(22) PCT Filed: Feb. 16, 2015

(86) PCT No.: PCT/EP2015/053197
§ 371 (c)(1),
(2) Date: Sep. 20, 2016

(87) PCT Pub. No.: WO2015/144358
PCT Pub. Date: Oct. 1, 2015

(65) Prior Publication Data

US 2017/0133801 A1 May 11, 2017

(30) Foreign Application Priority Data

Mar. 24, 2014 (DE) ..... 10 2014 103 991

(51) Int. Cl.
*H01R 13/73* (2006.01)
*H01R 13/627* (2006.01)

(52) U.S. Cl.
CPC ..... *H01R 13/73* (2013.01); *H01R 13/6273* (2013.01)

(58) Field of Classification Search
CPC .. H01R 13/745; H01R 13/74; H01R 13/6315; H01R 13/743
USPC ..... 439/550, 565, 545–547, 549
See application file for complete search history.

(56) References Cited

U.S. PATENT DOCUMENTS 2,337,267 A * 12/1943 Owen ..... G09F 13/26 248/50
3,537,064 A * 10/1970 Breslin ..... H01R 24/58 439/182
5,066,247 A * 11/1991 Watson ..... H01R 13/745 248/27.1
6,352,439 B1 * 3/2002 Stark ..... F16L 37/008 174/655

(Continued)

FOREIGN PATENT DOCUMENTS

CN 1679213 A 10/2005
EP 1942567 A2 7/2008

(Continued)

*Primary Examiner* — Gary Paumen
(74) *Attorney, Agent, or Firm* — Leydig, Voit & Mayer, Ltd.

(57) ABSTRACT

A connection arrangement includes a housing having a connecting portion on which at least one housing contact wedge is formed that has a contact surface that is oriented at a wedge angle to an assembly direction, and a connecting body which can he placed on the connecting portion and on which a connecting contact wedge is provided that has a contact surface oriented at the same wedge angle. A plurality of housing contact wedges is provided on the connecting portion of the housing so as to be spaced apart from one another. A groove for receiving the connecting contact wedge is formed between adjacent housing contact wedges.

13 Claims, 7 Drawing Sheets

(56) References Cited

U.S. PATENT DOCUMENTS

| | | | | |
|---|---|---|---|---|
| 6,637,538 | B2 * | 10/2003 | Morykon | F16B 21/18 180/313 |
| 7,547,230 | B1 * | 6/2009 | Strausser | H01R 13/745 439/545 |
| 7,806,723 | B2 * | 10/2010 | Chong | H02G 3/22 439/571 |
| 9,033,729 | B2 * | 5/2015 | Klein | H01R 13/62 439/549 |
| 2002/0185327 | A1 | 12/2002 | Morykon et al. | |
| 2005/0202718 | A1 | 9/2005 | Monte et al. | |
| 2010/0190375 | A1 * | 7/2010 | Rohde | H01R 13/746 439/549 |

FOREIGN PATENT DOCUMENTS

| | | | |
|---|---|---|---|
| EP | 2648285 | A1 | 10/2013 |
| JP | 2000346040 | A | 12/2000 |
| WO | WO 2004047234 | A1 | 6/2004 |

* cited by examiner

CONNECTION ARRANGEMENT

CROSS-REFERENCE TO PRIOR APPLICATIONS

This application is a U.S. National Phase application under 35 U.S.C. § 371 of International Application No. PCT/EP2015/053197, filed on Feb. 16, 2015, and claims benefit to German Patent Application No. DE 10 2014 103 991.2, filed on Mar. 24, 2014. The International Application was published in German on Oct. 1, 2015 as WO 2015/144358 A1 under PCT Article 21(2).

FIELD

The invention is related to a connection arrangement comprising a housing having a connecting portion on which at least one housing contact wedge is formed that has a contact surface that is oriented at a wedge angle to an assembly direction, and having a connecting body which can be placed on the connecting portion and on which a connecting contact wedge is provided that has a contact surface oriented at the same wedge angle.

BACKGROUND

Generic connection arrangements, by means of which connection terminals, for example, can be attached to a wall of an apparatus, are generally known and widespread. A contact wedge is provided in each case on the housing and on the connecting body. The contact wedges are positioned against one another and clamped in order to fasten the housing and the connecting body to the wall of the apparatus. For example, for fastening the connection terminals, the geometry of the housing or of the connecting body is tailored to the wall thickness of the apparatus. Each housing or each connecting body is in this case only suitable for specific apparatus wall thicknesses. For example, the contact wedge on the connecting body can be formed so as to be comparatively long in order to achieve a high degree of flexibility and to ensure fastening at as many different housing wall thicknesses as possible. However, depending on the actual geometric conditions, the connecting body can protrude comparatively far. It is also known to provide the housing contact wedge so as to be spaced far apart from the apparatus wall and, depending on the particular assembly situation, to insert spacer elements in order to ensure that the contact wedges are fastened to one another. However, this increases the assembly cost.

SUMMARY

A connection arrangement includes a housing having a connecting portion on which a plurality of housing contact wedges is formed, the housing contact wedges being spaces apart from each other and each having a contact surface that is oriented at a wedge angle to an assembly direction; and a connecting body configured to be placed on the connecting portion and on which a connecting contact wedge is provided that has a contact surface oriented at the wedge angle. A groove configured to receive the connecting contact wedge is formed between at least one set of adjacent ones of the housing contact wedges.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
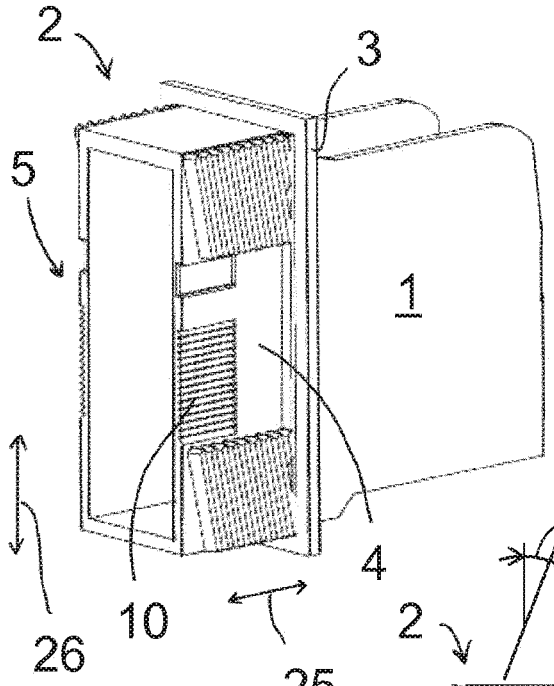
FIG. 1 is a perspective view of a housing of a connection arrangement according to the invention.

An advantage of the invention is that, depending on the connection geometry or on the apparatus wall thickness, the connecting contact wedge can be positioned on one suitable wedge of the provided housing contact wedges. In this respect, the provision of the plurality of housing contact wedges permits a flexible use of the connection arrangement for different apparatus wall thicknesses. The connecting body comprising the connecting contact wedge can nevertheless be made compact. Since additional components, for example spacer elements, are avoided, the assembly is also simple.

According to an embodiment of the invention, a plurality of connecting contact wedges is also provided on the connecting body. A receiving groove is also formed here between adjacent connecting contact wedges, which groove is intended to receive a housing contact wedge. Advantageously, the provision of parallel contact wedges can improve the stability and achieve precisely positioned assembly. Since a plurality of contact wedge pairings is provided, each individual contact surface can be made smaller and the connection arrangement can be given a particularly compact shape.

According to an embodiment of the invention, a number of connecting contact wedges on the connecting body is less than a number of housing contact wedges on the connecting portion of the housing. Advantageously, the connecting portion of the housing gives the option of providing the geometric compensation required in order to adapt the connecting arrangement to different housing wall thicknesses. The connecting body can be designed in a particularly compact manner. In this case, the flexibility with respect to the positioning of the connecting body on the connecting portion is maintained.

According to an embodiment of the invention, the housing contact wedges are arranged so as to be regularly spaced apart in the extension direction of the connecting portion. The connecting contact wedges can also be arranged in a regular manner. The receiving grooves formed between adjacent contact wedges preferably extend towards the wedge angle. The width of the receiving grooves and of the contact wedges, respectively, are in particular equal or tailored to one another such that the contact wedges can be inserted in the receiving grooves with a substantially exact fit. The assembly is simplified by the advantageous design of the connecting portion or of the connecting body. In particular, providing the receiving grooves during assembly results in form-fitting guidance of the components which can move relative to one another. The use of the connection arrangement according to the invention is intuitive in this respect. The stability is improved in the assembled state.

According to an embodiment of the invention, the connecting portion is formed so as to be closed on the outer side. The housing contact wedges are provided on two opposite outer lateral surfaces. In particular, the connecting body can be U-shaped, at least one connecting contact wedge being provided on each of the free legs on mutually facing inner sides of said legs. The connecting body advantageously comprises the connecting portion on the outer side. The contact wedges are associated with one another in an opposing manner. In this respect, in the assembly position, a favorable and optionally symmetrical load distribution results. In addition, good protection is ensured against unintentional tilting of the connection components (housing and connecting body) during assembly.

According to an embodiment of the invention, a latching connection is provided in order to fasten the connecting body to the connecting portion of the housing. For this purpose, a latching element engages in a latching receiver. For example, the latching element is provided on the connecting body, while the latching receiver is formed as part of the connecting portion or of the housing. In particular, the latching element can be provided on a free leg of the connecting body, the free leg having an inherent resilience due to its elongate shape or its individual design. A contact surface of the latching element can be profiled. The latching receiver has a corresponding profiling. The profiling on the contact surface and on the latching receiver can be regular, for example. Advantageously, providing the latching connection achieves improved securing against unintentional release in the assembly position of the connection arrangement. In this case, in particular providing a regular profiling results in a variable latching position. In this respect, the latching position can be occupied irrespective of the geometric conditions and in particular within dimensions of the housing wall thickness. In this respect, the latching connection is formed in just as variable a manner as the connection arrangement as a whole.

Figure 2:
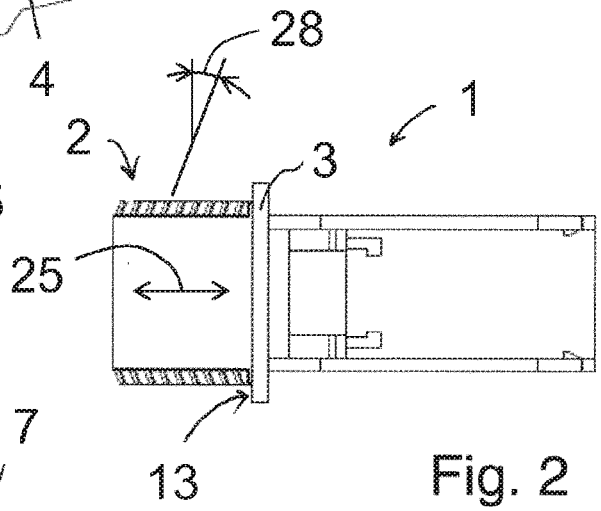
FIG. 2 is a plan view of the housing according to FIG. 1.
Figure 3:
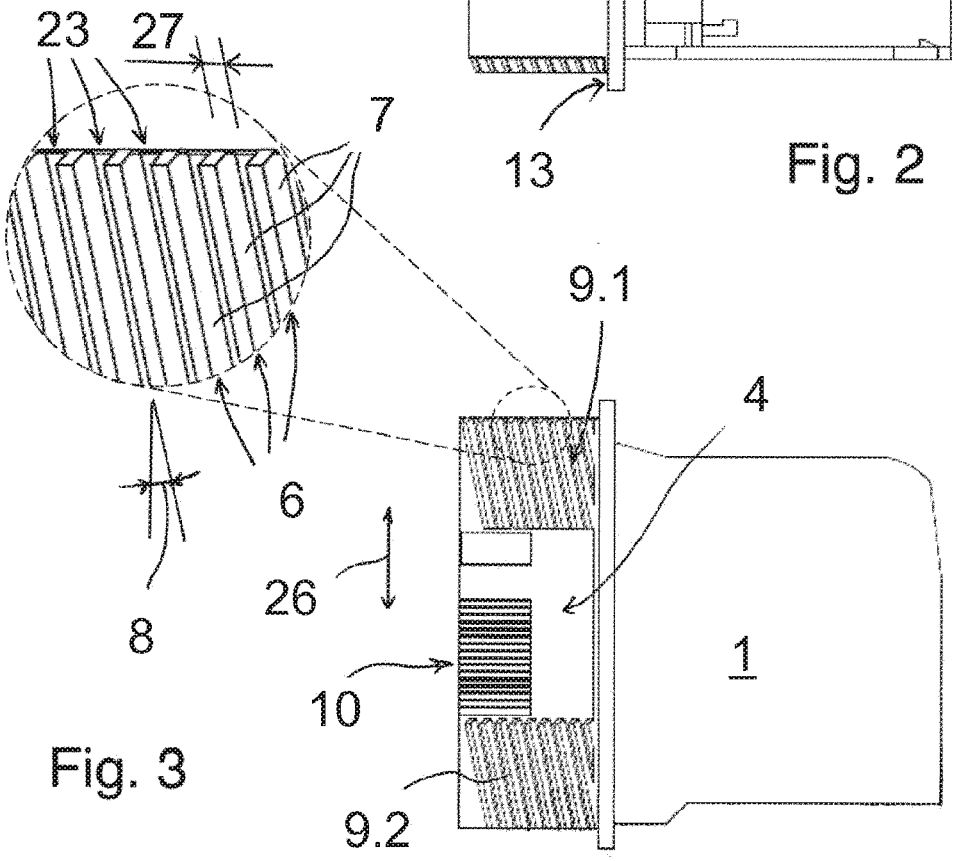
FIG. 3 is a side view of the housing according to FIG. 1.
Figure 4:
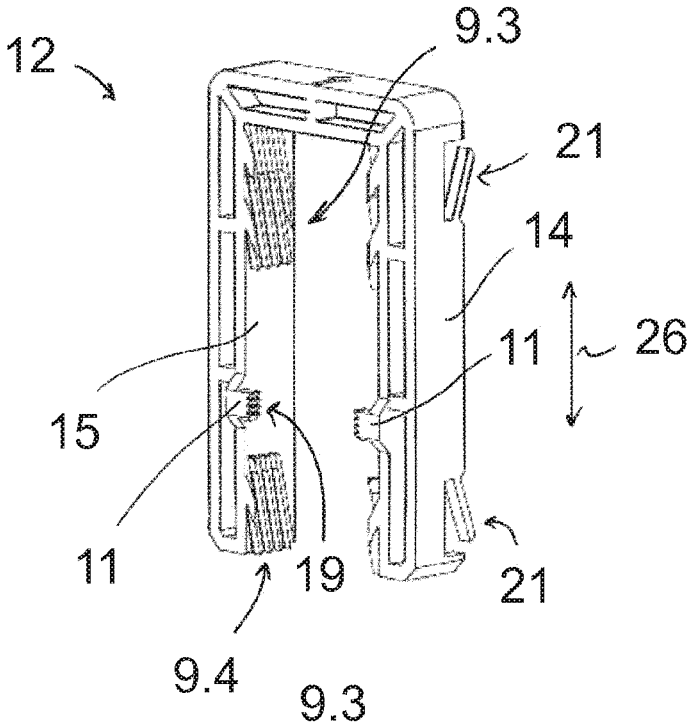
FIG. 4 is a perspective view of a connecting body of the connection arrangement according to the invention.
Figure 5:
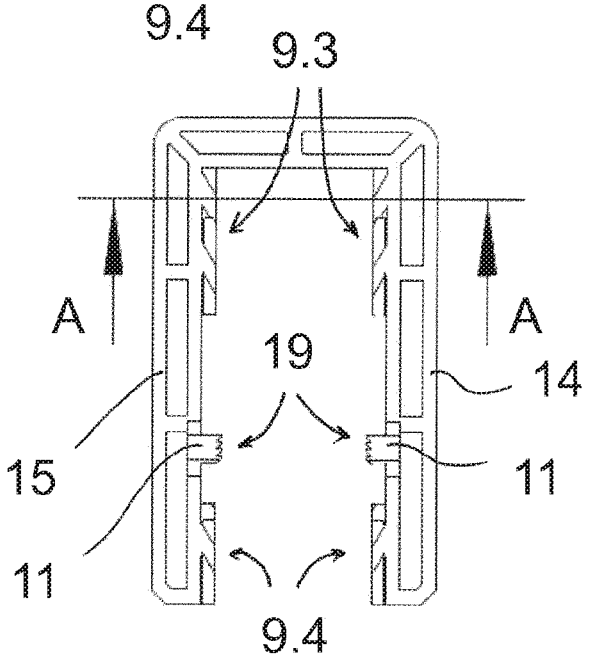
FIG. 5 shows a front side of the connecting body according to FIG. 4.
Figure 6:
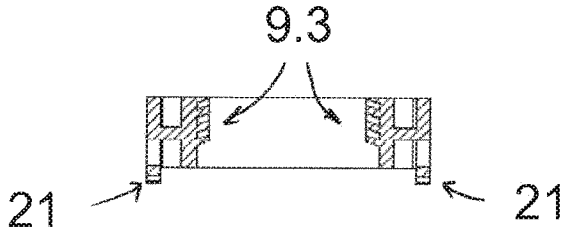
FIG. 6 is a section A-A through the connecting body according to FIG. 4.
Figure 7:
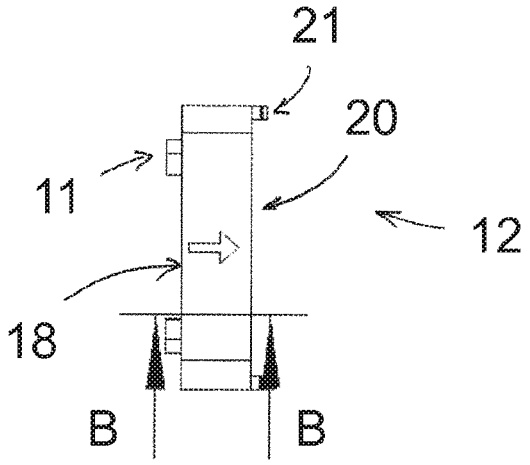
FIG. 7 is a plan view of the connecting body according to FIG. 4.
Figure 8:
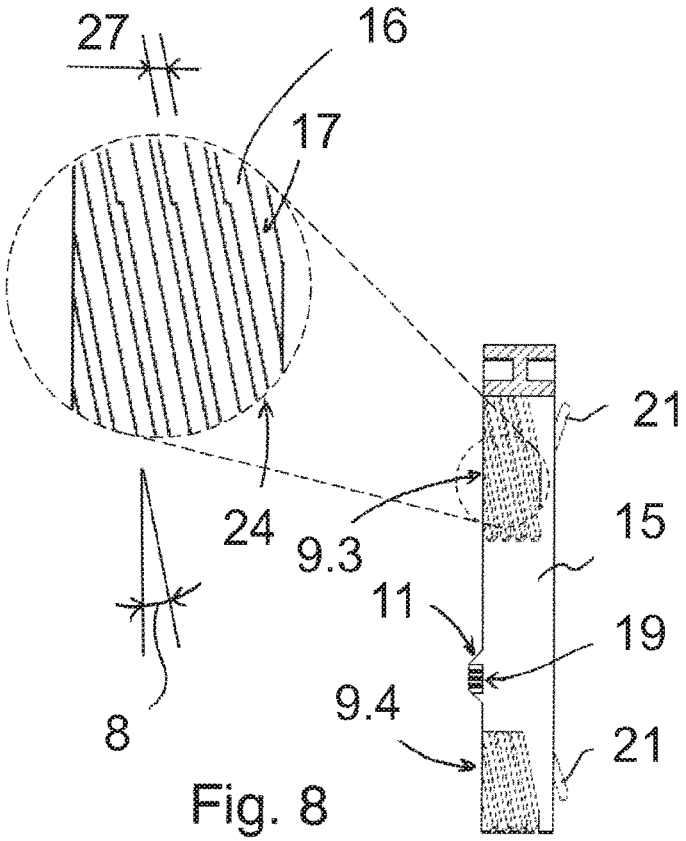
FIG. 8 is a section B-B through the connecting body according to FIG. 4.

A housing 1 according to FIGS. 1 to 3 of a connection arrangement according to the invention provides a connecting portion 2 and a contact portion 3 arranged adjacently to the connecting portion 2. The connecting portion 2 has a substantially rectangular cross section. A plurality of housing contact wedges 6 that are regularly spaced apart in an extension direction 25 of the connecting portion 2 and that are each adjacent to one another is formed on two mutually opposing outer lateral surfaces 4, 5. The outer lateral surfaces 5 define longitudinal sides of the connecting portion 2. The housing contact wedges 6 or the contact surfaces 7 formed on the flanks of the housing contact wedges 6 are oriented at a wedge angle 8 with respect to a longitudinal direction 26 of the outer lateral surfaces 4, 5. In the present embodiment of the invention, the wedge angle 8 is approximately 10°. The receiving grooves 23 extend at the same wedge angle 8, one receiving groove 23 being formed between two adjacent housing contact wedges 6.

The housing contact wedges 6 are provided on each outer lateral surface 4, 5 in two blocks 9.1, 9.2. The blocks 9.1, 9.2 are spaced apart from one another. A profiled surface 10 is formed between a first block 9.1 and a second block 9.2. The profiled surface 10 acts as a latching receiver for a latching element 11 provided on a connecting body 12 of the connection arrangement according to the invention. The latching receiver 10 and the latching element 11 together form a latching connection for fastening or fixing the connecting body 12 to the housing 1 of the connection arrangement.

The contact portion 3 has a contact surface 13 which faces the connecting portion 2 and is formed so as to be substantially even or flat. The contact surface 13 is used in particular for placing the housing 1 on an apparatus wall. The contact surface 13 protrudes in the radial direction beyond the outer surface of the connecting portion 2. The housing 1 is thus inserted, together with the connecting portion 2, into a recess provided on the apparatus wall, and is positioned relative to the housing wall by means of the contact surface 13.

An additional inclined position is superimposed on the inclined position of the contact surface 7 at the wedge angle 8. The contact surface 7 is arranged so as to be inclined perpendicularly to the extension direction 25 at a pitch angle 28, an undercut being formed. The pitch angle 28 is usually approximately 30°.

The connecting body 12 of the connection arrangement according to the invention is shown in FIGS. 4 to 8. The connecting body 12 is in particular U-shaped. Two mutually opposing free legs 14, 15 of the connecting body 12 are elongate and in particular flexurally resilient. Connecting contact wedges 16 are provided on mutually opposing inner sides of the free legs 14, 15. The connecting contact wedges 16 comprise contact surfaces 17 which are oriented so as to be pivoted at the wedge angle 8 to the longitudinal direction 26 of the free legs 14, 15 and inclined at the pitch angle 28 to the extension direction 25 of the connecting portion 2. Receiving grooves 24 are provided between adjacent connecting contact wedges 16. The connecting contact wedges 16 are provided on the two free legs 14, 15 in two blocks 9.3, 9.4 in each case. A spacing between a first block 9.3 and a second block 9.4 corresponds to the spacing of the blocks 9.1, 9.2 of the housing contact wedges 6 of the connecting portion 2.

The latching elements 11 are provided between the blocks 9.3, 9.4 in the region of a front side 18 of the connecting body 12. The latching elements 11, which are oriented towards an inner side of the opposing free leg 14, 15, comprise mutually facing profiled contact surfaces 19. The profiling of the contact surfaces 19 corresponds to the profiling of the latching receiver 10 on the connecting portion 2 of the housing 1. In the present embodiment of the invention, the profiling is formed in the manner of a linear knurling oriented in the extension direction 25.

A total of four resilient projections 21 are provided so as to protrude on a rear side 20 opposite the front side 18. The projections 21 are used for placing the connecting body 12 on the apparatus wall.

Figure 9:
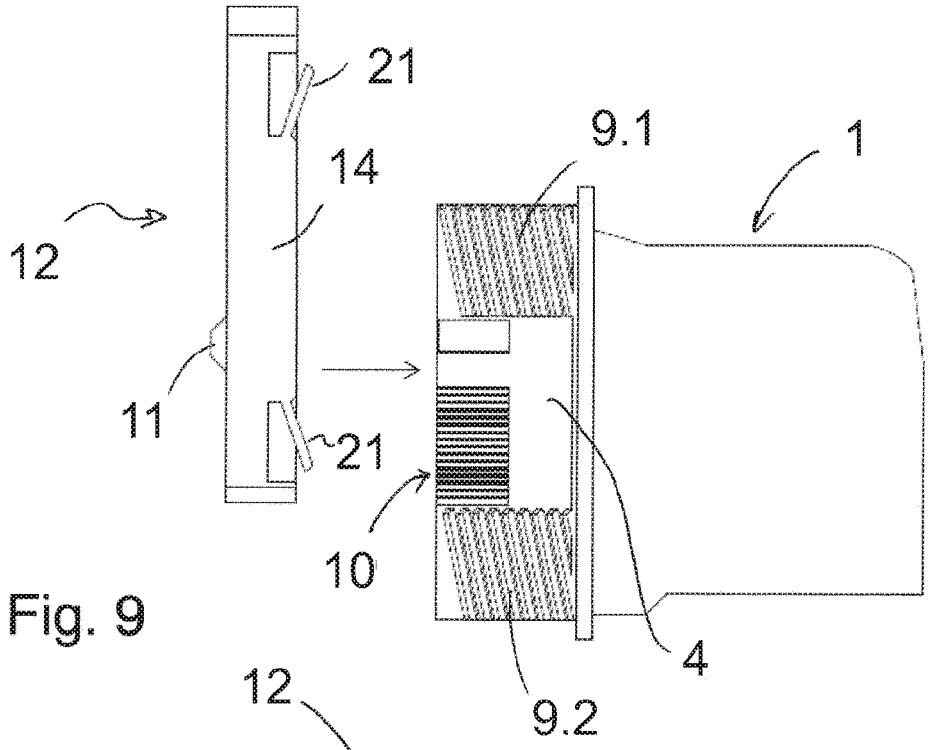
FIG. 9 shows a first assembly step when placing the connecting body on a connecting portion of the housing.
Figure 10:
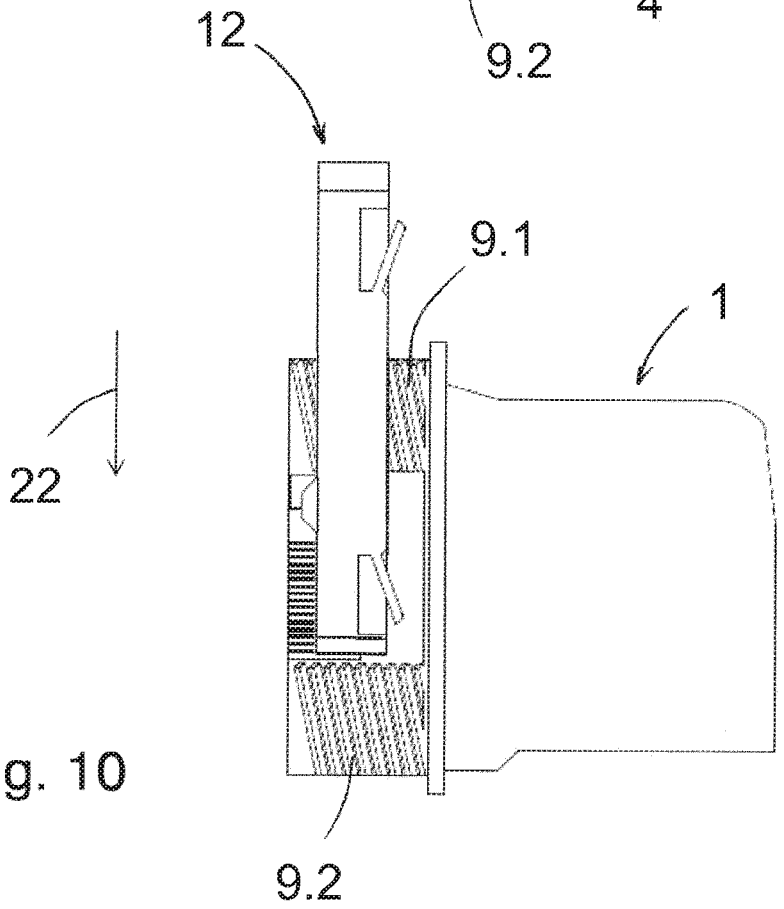
FIG. 10 shows a second assembly step for placing the connecting body on the connecting portion.

FIGS. 9 and 10 show the assembly of the connection arrangement. In a first step, the connecting body 12 is placed on the connecting portion 2 of the housing 1. The placement is carried out such that the connecting body 12 comprising the second block 9.4 of the connecting contact wedges 16 is provided between the first block 9.1 and the second block 9.2 of the housing contact wedges 6. The connecting body 12 is then inserted in the assembly direction 22. In this case, the connecting contact wedges 16 engage in the receiving grooves 23 which are formed between the housing contact wedges 6 on the connecting portion 2 of the housing 1. Similarly, the housing contact wedges 6 are guided into the receiving grooves 24 which are formed between the connecting contact wedges 16. In the present case, the housing contact wedges 6, the connecting contact wedges 16 and the receiving grooves 23, 24 have the same width 27.

In the assembled state of the connection arrangement according to FIGS. 11 to 15, the connecting body 12 is fastened to the connecting portion 2 of the housing 1. An apparatus wall is located between the contact surface 7 of the contact portion 3 and the rear side 20 of the connecting body 12. The resilient projections 21 act like spring elements and ensure that the contact surfaces 17 formed on the connecting contact wedges 16 are pressed against the contact surface 7 of the housing contact wedges 6. In order to secure against unintentional release of the connecting body 12 from the connecting portion 2 of the housing 1, the latching elements 11, which are provided on the free legs 14, 15, engage in the latching receiver 10 which is provided on the two opposite outer lateral surfaces 4, 5 of the connecting portion 2. Owing to the profiling of the contact surface 19 and the latching receiver 10, a positive fastening results here, the fastening of the connecting body 12 resulting in a simple manner during assembly owing to the resilience of the legs 14, 15. In addition, the wedge angle 8 can be selected such that self-locking takes place between the housing contact wedges 6 and the connecting contact wedges 16. In particular, the wedge angle 8 is smaller than 20°. The wedge angle 8 is preferably in the range of from 6° to 12°.

Figure 11:
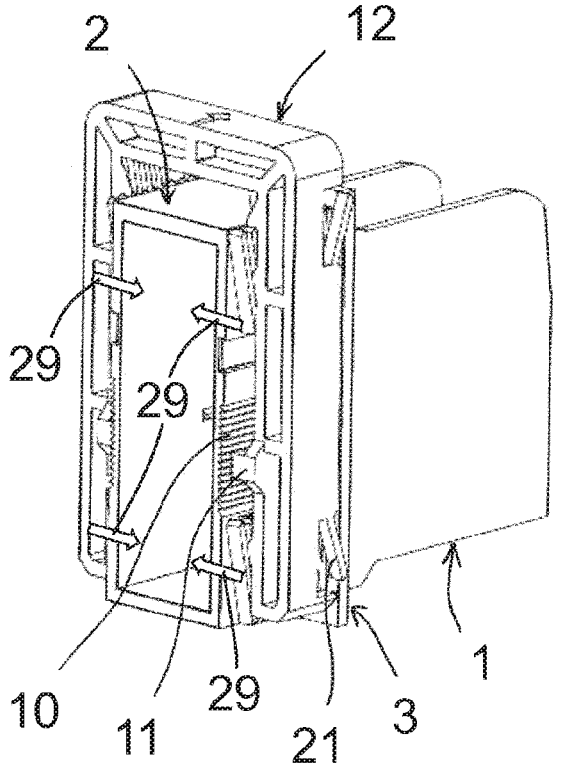
FIG. 11 is a perspective view of the connection arrangement according to the invention in an assembly position.
Figure 12:
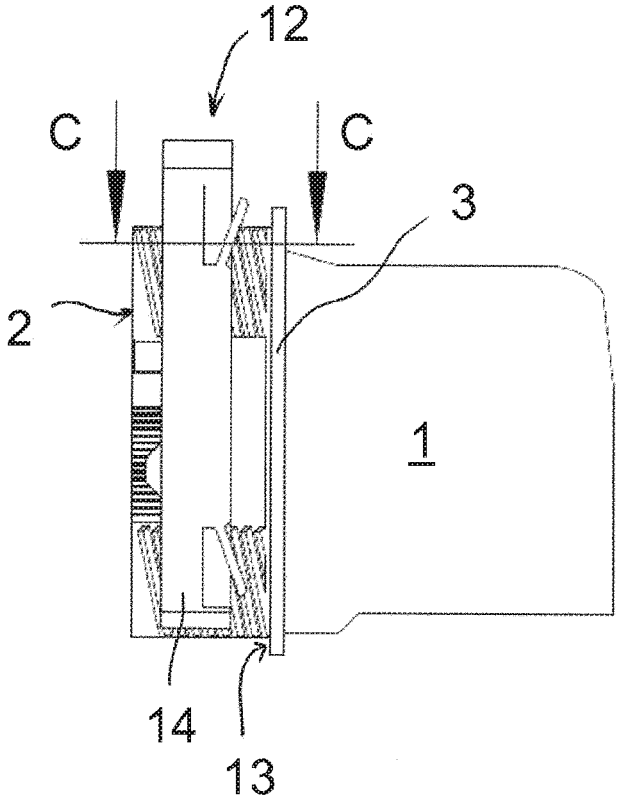
FIG. 12 is a side view of the connection arrangement according to FIG. 11.
Figure 13:
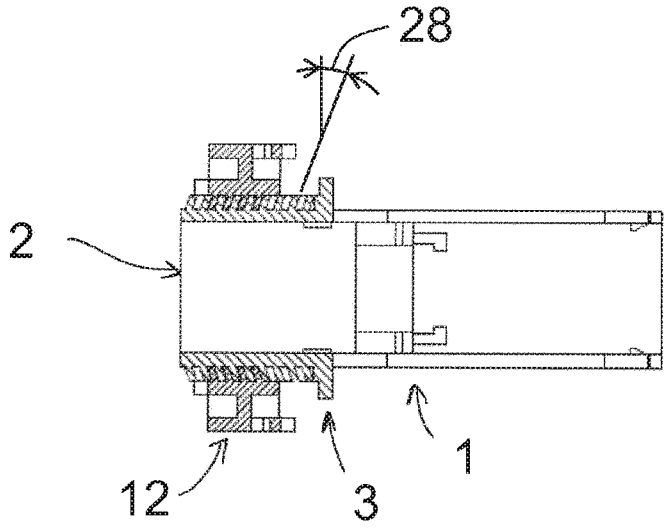
FIG. 13 is a section C-C through the connection arrangement according to FIG. 11.
Figure 14:
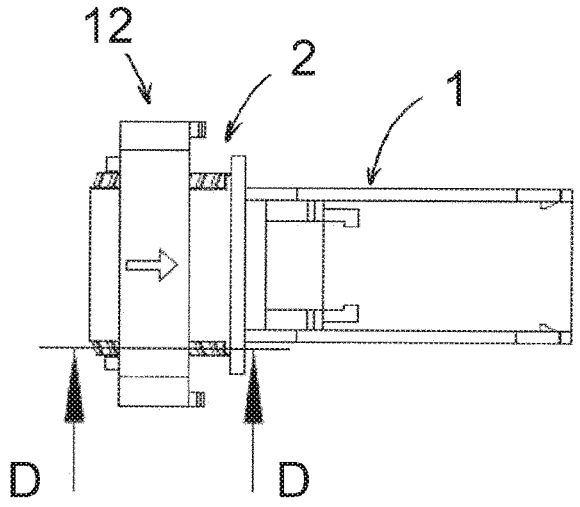
FIG. 14 is a plan view of the connection arrangement according to FIG. 11.
Figure 15:
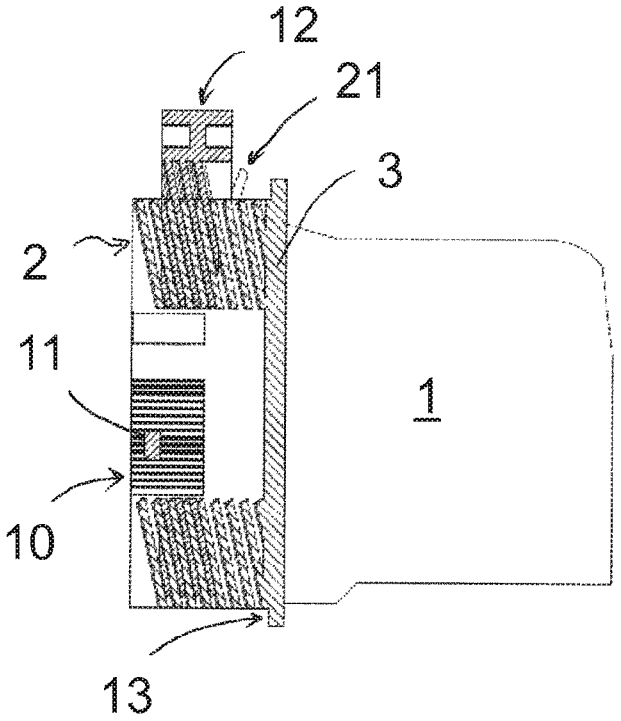
FIG. 15 is a section D-D through the connection arrangement according to FIG. 11.

Owing to the inclination of the contact surfaces 7, 17 at the pitch angle 28, the free legs 14, 15 of the connecting body 12 are moved closer to one another during assembly and wedged against the connecting portion 2 of the housing 1 in the assembled state of the connection arrangement; cf. arrow 29 in FIG. 11. In this respect, a particularly stable fastening to the apparatus wall thus results.

Identical components and component functions, and corresponding geometries, are denoted by identical reference signs.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 housing
2 connecting portion
3 contact portion
4 outer lateral surface
5 outer lateral surface
6 housing contact wedge
7 contact surface
8 wedge angle
9.1 block
9.2 block
9.3 block
9.4 block
10 latching receiver
11 latching element
12 connecting body
13 contact surface
14 free leg
15 free leg
16 connecting contact wedge
17 contact surface
18 front side
19 contact surface
20 rear side
21 projection
22 assembly direction
23 receiving groove
24 receiving groove
25 extension direction
26 longitudinal direction
27 width
28 pitch angle
29 arrow

The invention claimed is:

1. A connection arrangement comprising:

a housing having a connecting portion with a substantially rectangular cross section comprising two outer lateral surfaces that are parallel to one another, each of the two outer lateral surfaces including a plurality of housing contact wedges, the housing contact wedges being spaced apart from each other and each having a contact surface that is oriented at a wedge angle to an assembly direction; and a connecting body configured to be placed on the connecting portion and on which a connecting contact wedge is provided that has a contact surface oriented at the wedge angle, wherein a groove configured to receive the connecting contact wedge is formed between at least one set of adjacent ones of the housing contact wedges.

2. The connection arrangement according to claim 1, wherein a plurality of connecting contact wedges is provided on the connecting body, a respective groove configured to receive a housing contact wedge being formed between respective adjacent ones of the connecting contact wedges.

3. The connection arrangement according to claim 2, wherein a number of connecting contact wedges on the connecting body is less than a number of housing contact wedges on the connecting portion of the housing.

4. The connection arrangement according to claim 1, wherein the housing contact wedges are arranged so as to be regularly spaced apart in an extension direction of the connecting portion.

5. The connection arrangement according to claim 1, wherein the groove extends towards the wedge angle.

6. The connection arrangement according to claim 1, wherein the groove and/or the housing contact wedges and/or the connecting contact wedge have the same width.

7. The connection arrangement according to claim 4, wherein the extension direction of the connecting portion is provided at a right angle to the assembly direction of the connecting body.

8. The connection arrangement according to claim 1, wherein the connecting portion is formed so as to be closed on an outer side thereof.

9. The connection arrangement according to claim 1, wherein the connecting body is U-shaped, at least one of two free legs of the connecting body being flexurally resilient and/or at least one connecting contact wedge being provided on each of the free legs on mutually facing inner sides of the legs.

10. The connection arrangement according to claim 1, wherein a latching connection is provided to fasten the connecting body to the connecting portion, a resilient latching element engaging in a latching receiver.

11. The connection arrangement according to claim 10, wherein a contact surface of the latching element is profiled and the latching receiver is correspondingly profiled.

12. The connection arrangement according to claim 11, wherein a profiling of the contact surface and a corresponding profiling of the latching receiver are regular.

13. The connection arrangement according to claim 1, wherein the housing contact wedges are provided on each of the two outer lateral surfaces in two block.

* * * * *